US007832889B1

(12) United States Patent
Cogliano

(10) Patent No.: US 7,832,889 B1
(45) Date of Patent: Nov. 16, 2010

(54) RECESSED LIGHT HOUSING WITH A ROTATABLE APERTURE

(75) Inventor: Frank Cogliano, New Windsor, NY (US)

(73) Assignee: USAI LLC, New Windsor, NY (US)

( * ) Notice: Subject to any disclaimer, the term of this patent is extended or adjusted under 35 U.S.C. 154(b) by 452 days.

(21) Appl. No.: 11/524,640

(22) Filed: Sep. 21, 2006

(51) Int. Cl.
*F21S 8/00* (2006.01)
*F21V 15/00* (2006.01)

(52) U.S. Cl. ..... 362/147; 362/269; 362/277; 362/364; 362/375

(58) Field of Classification Search ..... 362/147, 362/366, 374–375, 269, 277, 280, 148, 364
See application file for complete search history.

(56) References Cited

U.S. PATENT DOCUMENTS

| | | | | |
|---|---|---|---|---|
| 3,908,120 | A | 9/1975 | Greene | |
| 4,096,554 | A | 6/1978 | Greene | |
| 4,368,506 | A | 1/1983 | Rapp | |
| 4,444,369 | A | 4/1984 | Job | |
| 4,475,147 | A * | 10/1984 | Kristofek | 362/148 |
| 4,645,286 | A | 2/1987 | Isban et al. | |
| 4,645,289 | A * | 2/1987 | Isban | 439/101 |
| 4,760,507 | A | 7/1988 | Lasker et al. | |
| 5,349,513 | A | 9/1994 | Taylor, III | |
| 6,082,878 | A | 7/2000 | Doubek et al. | |
| 6,176,594 | B1 | 1/2001 | Yarconi | |
| 6,877,703 | B2 | 4/2005 | Tang | |
| 7,014,332 | B2 | 3/2006 | Sergio et al. | |
| 7,186,008 | B2 * | 3/2007 | Patti | 362/365 |
| 2007/0019418 | A1 | 1/2007 | Czech et al. | |
| 2007/0274082 | A1 * | 11/2007 | Kay | 362/364 |
| 2008/0025031 | A1 * | 1/2008 | Wronski et al. | 362/365 |

* cited by examiner

*Primary Examiner*—Jason Moon Han
*Assistant Examiner*—Sean P Gramling
(74) *Attorney, Agent, or Firm*—St. Onge Steward Johnston & Reens LLC

(57) ABSTRACT

A recessed light assembly having an illumination element and having an enclosure attachable to a support structure of a dwelling has a rotating aperture plate rotatably mounted to a wall of the enclosure. The rotating aperture plate has an illumination aperture disposed over an opening in the wall of the enclosure and the recessed light assembly has adjustable fasteners, accessible from an exterior of the recessed light assembly, which adjustable fasteners selectively permit and prevent rotation of the rotating aperture plate relative to the enclosure allowing a user to adjust the rotational alignment of the illumination aperture relative to the enclosure of an installed light assembly without disengaging an attached assembly from the support structure. The illumination element may be fixed relative to the rotating aperture plate or may be fixed relative to the enclosure. The rotating aperture plate and the enclosure may have rotational alignment reference marks and a rotational alignment indicator which serve to indicate a present rotational alignment of the aperture plate relative to the enclosure.

25 Claims, 7 Drawing Sheets

RECESSED LIGHT HOUSING WITH A ROTATABLE APERTURE

FIELD OF THE INVENTION

The invention pertains to the field of recessed lighting and, in particular, to recessed lighting assemblies.

BACKGROUND OF THE INVENTION

Recessed lighting is very popular because it provides light in a subtle, unobtrusive manner providing improved decor. A recessed light assembly typically comprises a box-like enclosure with a fixed illumination aperture located on a wall of the enclosure and with an illumination element affixed inside the enclosure. Other apertures in the enclosure may be present for routing electrical power and control lines or for ventilation. For practical and regulatory reasons, such assemblies are typically constructed primarily of unpainted metal (such as sheet metal) and the enclosure is usually entirely metal. Such assemblies are typically affixed to a support structure within a ceiling or wall in order to provide a secure, concealed attachment.

Illumination apertures of many different sizes and shapes are available to suit the style preferences of the purchaser. Non-round illumination apertures, such as square, rectangle, oval, etc., are often preferred. Such non-round illumination apertures are aligned with the axes of the enclosure such that, for example, the sides of a square illumination aperture are parallel to the adjacent side of the enclosure. Users of such recessed light assemblies with non-round illumination apertures often strongly prefer or demand that the illumination apertures be aligned parallel to a wall or axis of the room, or that they be in some other particular alternate alignment.

Obtaining a desired (i.e., parallel or particular alternate) alignment of a non-round illumination aperture of a recessed light assembly is often difficult to accomplish when securing the recessed light assembly within a ceiling or wall because the support structure may be out of alignment or may not have the desired particular alignment and/or the light assembly may be installed improperly. Further, aligning a non-round illumination aperture in a particular alternate alignment (e.g., 45 degrees from parallel to a wall) is often not possible or is difficult and/or imprecise using a conventional recessed light assembly having a fixed illumination aperture.

When a conventional recessed light assembly is installed in a misaligned orientation, the user must uninstall and reinstall the entire assembly in order to properly align the illumination aperture. This increases the work necessary for proper installation, the costs of such installation, and the wear and damage to the support structure and recessed light assembly.

To increase the efficiency, precision and flexibility of the installation of recessed light assemblies it is therefore desired to have a recessed light assembly with an illumination aperture that is rotatable independently of the enclosure so that adjustments to the alignment of the illumination aperture can be made after installation of the recessed light assembly without having to reinstall the entire assembly and so that a particular desired alignment can be easily obtained. It is also desired that the position of the illumination element within the enclosure is movable with the aperture, independently of the enclosure.

Therefore, it is an object of the invention to provide a recessed light assembly that has an illumination aperture that can be rotated independently of the enclosure.

It is another object of the present invention to provide a recessed light assembly having an illumination aperture that can be rotated in an easy and efficient manner.

It is another object of the present invention to provide a recessed light assembly having an illumination aperture that can be rotated after the assembly has been installed to the support structure.

It is still a further object of the present invention to provide a recessed light assembly that has an illumination element that can be rotated independently of the light housing.

It is yet another object of the present invention to provide a recessed light assembly that has an illumination element which rotates together with the rotatable illumination aperture.

It is another object of the present invention to provide a recessed light assembly that is economical to manufacture.

SUMMARY OF THE INVENTION

The foregoing objects are met by the present invention directed to a recessed light assembly with a rotatable aperture plate. The improved recessed light assembly features an enclosure affixable within a ceiling, wall or other support structure. The enclosure has a wall with an opening and an illumination element is disposed within the enclosure.

A rotating aperture plate having an illumination aperture is rotatably mounted to the enclosure and the recessed light assembly preferably has means to selectively permit and prevent rotation of the rotating aperture plate relative to the enclosure. The means to permit and prevent rotation of the rotating aperture plate relative to the enclosure preferably includes adjustable fasteners that selectively clamp the rotating aperture plate to the enclosure through one or more arcuate slots that are disposed on the rotating aperture plate. This allows the user to selectively rotate the rotating aperture plate to and between a variety of positions relative to the enclosure before clamping the aperture plate to the enclosure.

The improved recessed light assembly allows the user to adjust the rotational alignment of the illumination aperture relative to the enclosure after the assembly is installed without needing to disengage the attached assembly from the ceiling or wall.

The illumination element may be fixed relative to the rotating aperture plate so that rotation of the rotating aperture plate causes the illumination element to rotate accordingly, independently of the enclosure.

The rotating aperture plate or the wall of the enclosure has a rotational alignment reference mark affixed thereon and the corresponding wall of the enclosure or rotating aperture plate has a plurality of rotational alignment indicators affixed thereon which serve to indicate a present rotational alignment of the rotating aperture plate relative to the enclosure.

The recessed lighting assembly has a removable mechanism to selectively fix the rotating aperture plate in a positive, predetermined rotational alignment relative to the enclosure, such as a position wherein the sides of a square illumination aperture are aligned parallel to adjacent sides of a rectangular enclosure.

DESCRIPTION OF THE DRAWINGS

The above and other objects, features and advantages of the present invention will become apparent from the following description of a preferred but, nonetheless, illustrative embodiment of the invention, taken in conjunction with the accompanying drawings, wherein.

DETAILED DESCRIPTION OF THE PREFERRED EMBODIMENTS

Figure 1:
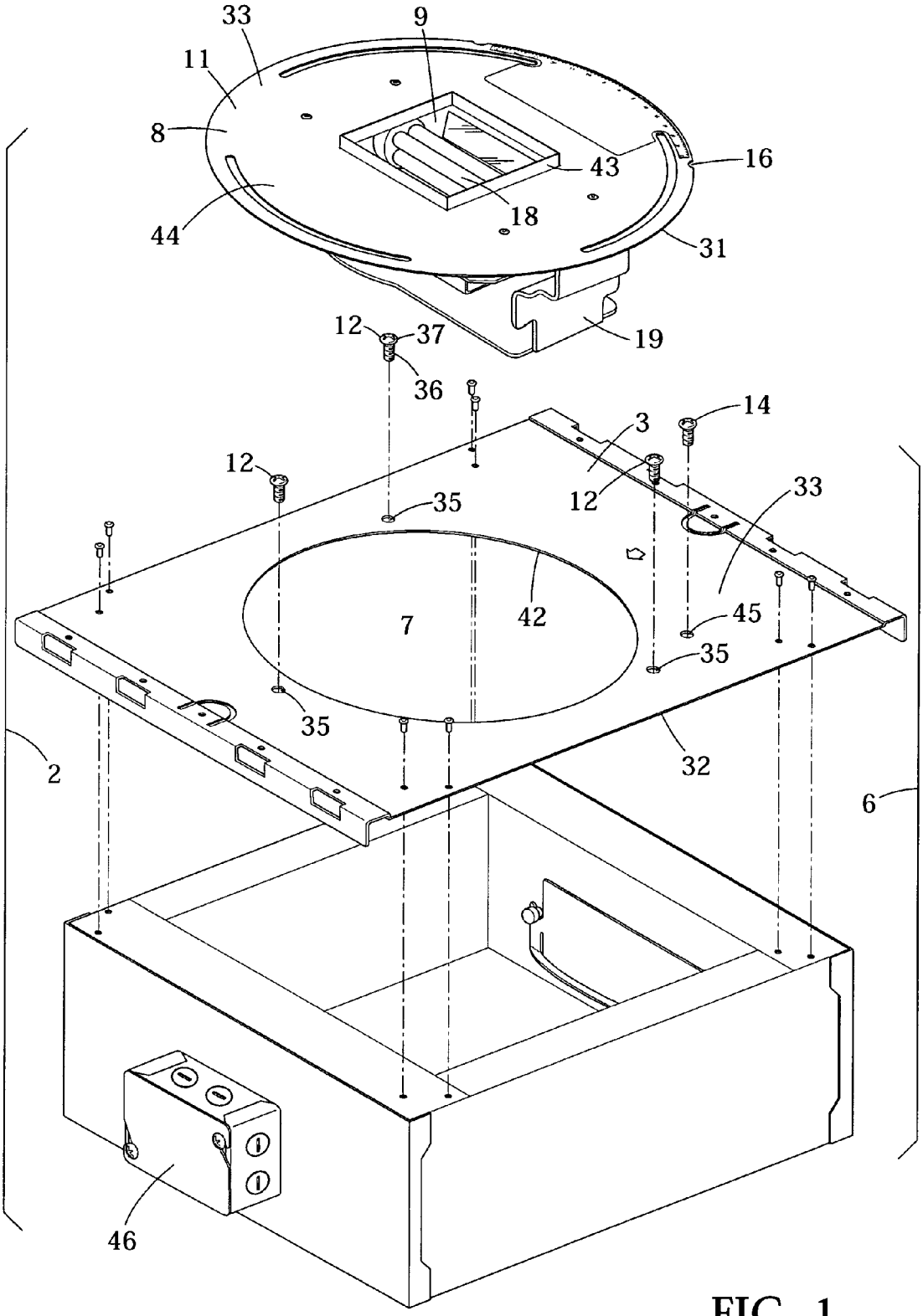
FIG. 1 is an exploded view of the improved recessed light.
Figure 2:
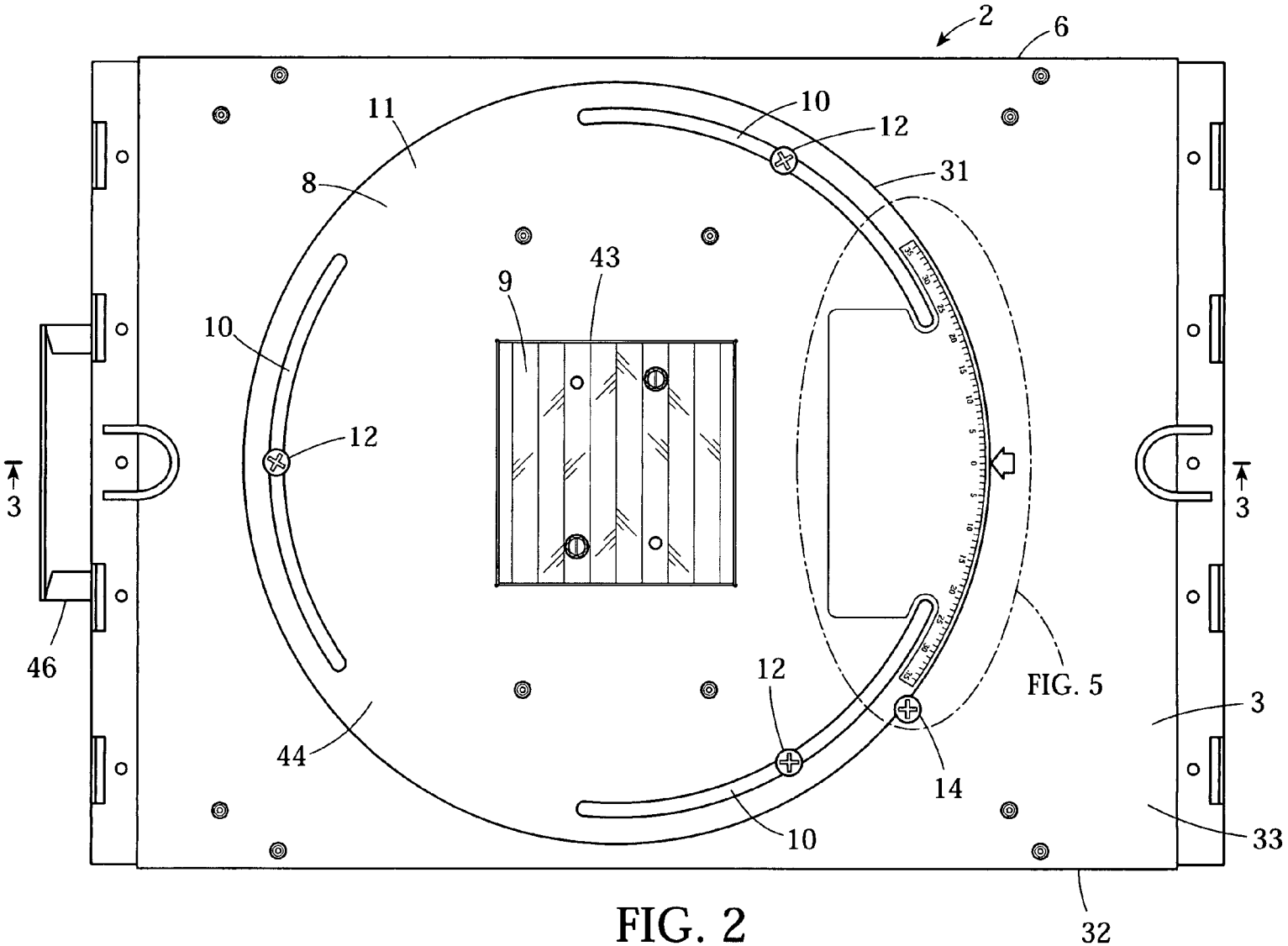
FIG. 2 is a bottom plan view of the improved recessed light assembly.

Referring to FIGS. 1 through 7, the present invention is directed to a recessed light assembly 2, which includes an enclosure 6 having a wall 3 (such as a bottom wall) with an opening 7 therethrough and includes an illumination element 18 disposed within the enclosure 6. The enclosure 6 is preferably formed entirely or primarily of metal (such as sheet metal) and preferably, though not necessarily, is in the form of a box-like structure having six substantially orthogonal sides or walls. Alternatively, the enclosure may have other forms or may consist of a single wall 3 with an opening 7. As depicted, the wall 3 of the enclosure 6 may be separable from the remainder of the enclosure 6.

The enclosure 6 is fixable to a support structure of a dwelling, such as support studs or other support structure on the surface or within a wall or ceiling. As is typical, it is anticipated that the recessed light assembly 2 will be installed during construction (or re-construction) of the dwelling or room and that the enclosure 6 may be substantially or entirely concealed within the wall or ceiling. In such instance, a hole is formed in the ceiling or wall to permit light generated by the illumination element 18 to pass into the room.

Figure 6:
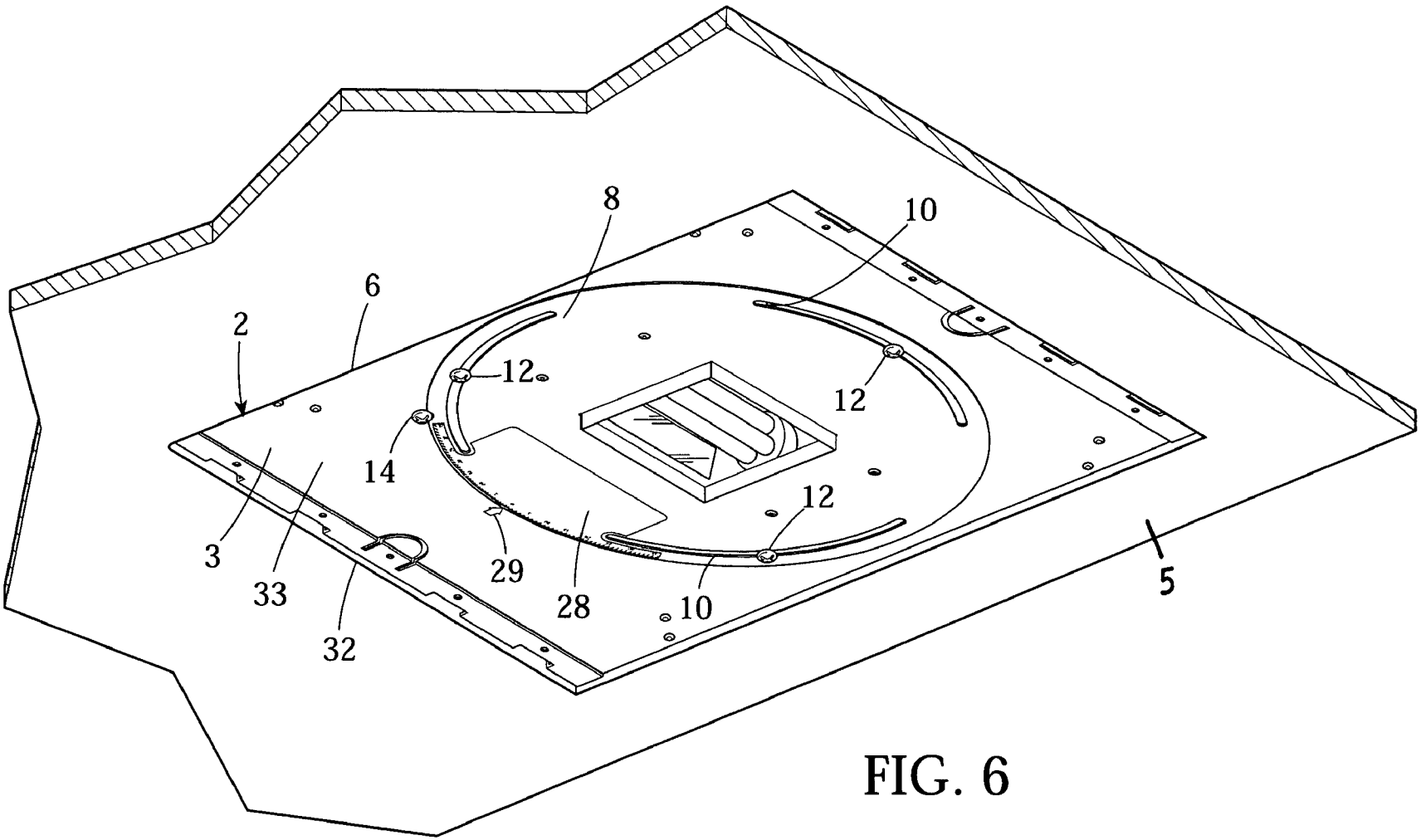
FIG. 6 is a perspective view of the recessed light assembly installed in an unfinished ceiling, showing the rotating aperture plate and illumination aperture in a predetermined rotational alignment.
Figure 7:
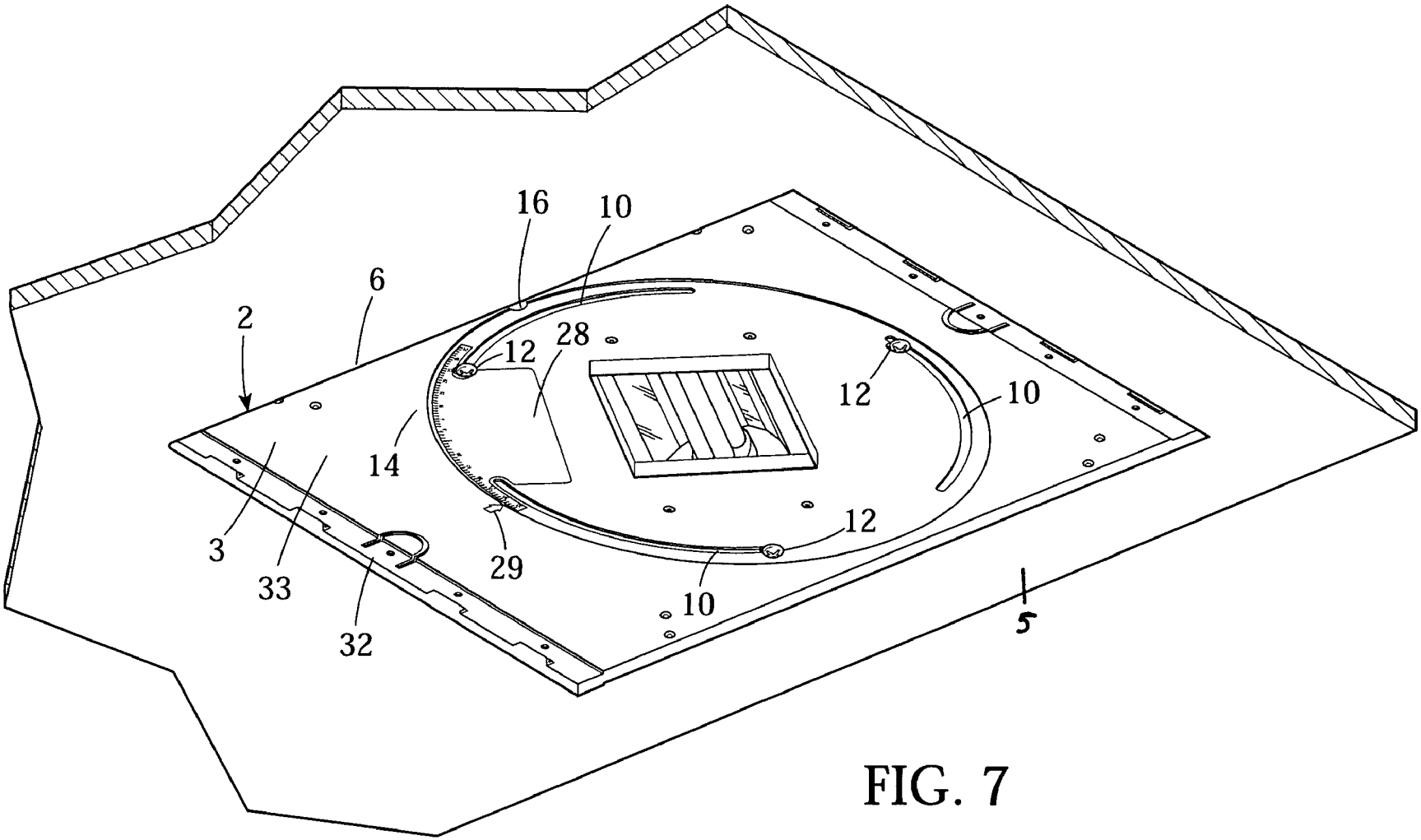
FIG. 7 is a perspective view of the recessed light assembly installed in an unfinished ceiling, showing the rotating aperture plate and illumination aperture angularly displaced from the predetermine rotation alignment.

FIGS. 6-7 show the recessed light assembly installed in an unfinished ceiling with the wall 3 of the enclosure exposed. As displayed in FIG. 3, when the construction of the dwelling is complete, the ceiling or wall surface structure 5 conceals the enclosure 6 except for the illumination aperture 9. Preferably, there is a small gap (usually about ½ inch to ¼ inch or less) between the ceiling or wall surface structure 5 and a peripheral flange 43 that surrounds the illumination aperture 9.

A rotating aperture plate 8 having a base 11 and an illumination aperture 9 is rotatably mounted to the wall 3 of the enclosure 6. The base 11 of the rotating aperture plate 8 preferably has a periphery 31 that is within a periphery 32 of the wall 3 of the enclosure 6. In a preferred embodiment, the periphery 31 of the base 11 of the rotating aperture plate 8 is substantially circular and the periphery 32 of the wall 3 of the enclosure 6 is substantially rectilinear (e.g., rectangular) or some other linear shape.

The rotating aperture plate 8 can be rotatably mounted to the enclosure 6 by any suitable method that allows the rotational alignment of the rotating aperture plate 8 to be adjusted, relative to the enclosure 6. Mechanisms to rotatably mount the rotating aperture plate 8 to the enclosure 6 may include, without limitation, spring-loaded or fixed clips, roller bearings, arms or a ring, or the like that rotatably support or suspend the rotating aperture plate 8 from the enclosure 6 (such as on the periphery 31 or an interior portion of the base 11).

Preferably, the rotating aperture plate 8 is mounted to the enclosure 6 such that an interior surface 39 of the base 11 of the rotating aperture plate 8 abuts an exterior surface 33 of the wall 3 of the enclosure 6, so that the base 11 of the rotating aperture plate 8 is outside the enclosure 6. Alternatively, the rotating aperture plate 8 may be affixed such that the aperture plate 8 abuts an interior surface 34 of the wall 3 of the enclosure 6, so that the base 11 of the rotating aperture plate 8 is within the enclosure 6. In any case, it is preferable that the abutting surfaces of the rotating aperture plate 8 and enclosure 6 are substantially planar.

When the rotating aperture plate 8 is mounted to the enclosure 6, the illumination aperture 9 and the opening 7 in the wall 3 of the enclosure form a light passageway of sufficient size to permit substantially all of or at least an effective amount of the light emitted from the illumination element 18 to exit the light assembly 2.

The illumination aperture 9 may have a variety of shapes and its shape may be substantially different or identical to the shape of the opening 7 in the wall 3 of the enclosure 6. However, it is preferred that the illumination aperture 9 has a non-round shape, such as the square shape depicted. Other preferred shapes for the illumination aperture 9 include a rectangular or oval shape, or other non-round shape. Additionally, the illumination aperture 9 may have an area that is less than the area of the opening 7 in the wall 3 of the enclosure 6.

The recessed light assembly 2 may be desirable for round illumination apertures. For example, in so-called "wall-wash" recessed light configurations, the illumination element (and usually the reflector) is directed at an angle relative to the wall 3 of the enclosure 6 such that, when the recessed light assembly 2 is installed in a ceiling, the light emitted therefrom is directed at an angle relative to the ceiling and at a nearby wall (i.e., not straight down toward the floor). The recessed light assembly 2 may be particularly desirable for such configurations, even if the illumination aperture 9 is round, substantially round or some other non-round shape, because the ability to adjust the alignment of the rotating aperture plate 8 (and illumination element and reflector) permits the user to adjust and refine the rotational orientation of the light emitted from recessed light assembly 2 efficiently and precisely.

The recessed light assembly 2 has means to selectively permit and prevent rotation of the rotating aperture plate 8 relative to the enclosure 6 in order to allow for adjustment of the rotational alignment of the illumination aperture 9 relative to the enclosure 6. Generally, the rotating aperture plate 8 is rotatably movable, relative to the enclosure 6, between at least first and second positions wherein the rotating aperture plate 8 is in first and second rotational orientations, respectively. However, the rotational alignment of the rotating aperture plate 8 is preferably adjustable to any position between and including the first and second positions.

The angular displacement between the first and second rotational orientations of the rotating aperture plate 8 is centered about a center of rotation of the rotating aperture plate 8, which center of rotation preferably lies within the illumination aperture 9. More preferably, the center of rotation lies on or substantially on a center point of the illumination aperture 9, such that a lateral position of the illumination aperture 9 relative to the enclosure 6 remains constant as the rotating aperture plate 8 rotates. Alternatively, the center of rotation of the rotating aperture plate 8 can be offset from the center of the illumination aperture 9.

Preferably, clamping means secure the rotating aperture plate 8 to the enclosure 6 for selectively permitting and preventing rotation of the rotating aperture plate 8. The clamping means can include one or a plurality of adjustable fasteners, such as threaded screws. Each adjustable fastener is preferably directed through an associated arcuate slot 10 disposed on the base 11 of the rotating aperture plate 8 or on the wall 3 of the enclosure 6. Such arcuate slots 10 are preferably non-threaded and preferably have a substantially constant width along their length. Each adjustable fastener is also directed into an associated receiving portion 35, such as a threaded recess, on the wall 3 of the enclosure 6 or rotating aperture plate 8. In the depicted embodiment, a plurality of arcuate slots 10 are disposed on the rotating aperture plate 8 and a plurality of associated receiving portions 35 are disposed on the wall 3 of the enclosure 6.

The arcuate slots 10 have a common center of curvature, which center of curvature defines the center of rotation of the rotating aperture plate 8 and illumination aperture 9 and lies on the axis of rotation thereof. The arcuate slots 10 allow the user to selectively rotate the rotating aperture plate 8 between a variety of positions relative to the enclosure 6 when the adjustable fasteners are disengaged. When the desired alignment is reached, the user may engage the adjustable fasteners to clamp the rotating aperture plate 8 to the enclosure 6 in the desired alignment. This process may be easily and conveniently repeated, before or after installation of the recessed light assembly, to adjust or refine the alignment of the illumination aperture 9.

In the depicted embodiment, the arcuate slots 10 each sweep an arc of about 70 degrees and thus allow for the rotation of the rotating aperture plate 8 by about 35 degrees in either direction. Alternatively, the arcuate slots 10 may be shortened or elongated and may be increase or decreased in number to allow for rotation from more than zero degrees to up to 360 degrees or more in either direction.

The adjustable fasteners preferably comprise a plurality of threaded adjustment screws 12 and a locking screw 14. However, there may be one or a plurality of adjustment screws 12 in any suitable amount and other suitable fastening means may also be used. Preferably, each threaded screw 12 has a shaft portion 36 having a diameter less than the width of the arcuate slots 10 and has a head portion 37 having a diameter greater than the width of the arcuate slots 10 such that the threaded screws 10 can clamp the rotating aperture plate 8 to the enclosure 6.

It is preferable that the adjustable fasteners need not be removed when they are disengaged (to permit selective rotation of the rotating aperture plate 8). It is further desirable that the adjustable fasteners are accessible and adjustable from an exterior of the recessed lighting assembly 2, such that the rotational alignment of the rotating aperture plate 8 may be adjusted after the recessed lighting assembly 2 is affixed to the structure of the dwelling and, thus, after the final alignment of the affixed enclosure 6 is known.

In a preferred embodiment, the adjustable fasteners are operable to maintain a connection between the rotating aperture plate 8 and the enclosure 6 when they are disengaged (to permit rotation of the rotating aperture plate 8). Instead, the adjustable fasteners may preferably be disengaged without disconnecting the rotating aperture plate 8 from the enclosure 6. In the case where the adjustable fasteners are threaded screws 12, the adjustable fasteners may be disengaged by partially loosening, but not removing, the screws 12 such that the rotating aperture plate 8 is no longer fixedly clamped to the enclosure 6. This allows the rotational alignment of the rotating aperture plate 8 to be safely and conveniently adjusted, particularly when the base 11 of the rotating aperture plate 8 is mounted to the exterior 33 of the wall 3 of the enclosure 6 and when, as is usually the case after installation of such an embodiment, the base 11 is located vertically below the enclosure 6. In any case, however, the ability to adjust the rotational alignment of the rotating aperture plate 8 without removing and re-inserting the adjustable fasteners provides for efficient and convenient adjustment of the alignment of the rotating aperture plate 8.

Any suitable structure to selectively permit and prevent rotation of the rotating aperture plate 8 relative to the enclosure 6 may be employed, however such a structure is not a necessary feature. Another mechanism to selectively permit and prevent rotation of the rotating aperture plate 8 relative to the enclosure may include one or more screws threaded to the wall 3 of the enclosure 6, around the periphery 31 of the base 11 of the rotating aperture plate 8, which when engaged (e.g., tightened) contact and clamp the base 11 to the enclosure 6. Another such mechanism may include a ratchet or the like that permits discrete adjustments of the rotational alignment of the rotating aperture plate 8 upon application of at least a predetermined amount of torque to the rotating aperture plate 8 or upon selective disengagement of the ratchet. Another such mechanism may include a source of substantial friction on the rotating aperture plate 8 which prevents rotation of the rotating aperture plate 8 unless at least a predetermined amount of torque is applied to the rotating aperture plate 8, to allow user-induced or forced rotation and to prevent free or unintended rotation, where the substantial friction is preferably greater (or substantially greater) than an amount of friction inherently created by the weight of the rotating aperture plate 8. The source of substantial friction may include one or more spring-loaded clamps acting on the rotating aperture plate 8 (or base 11 thereof), or friction pads compressed between the rotating aperture plate 8 and enclosure 6, or a low-tolerance friction-inducing connection therebetween, or the like. A further such mechanism may include removable or permanent adhesive (such as glue or tape) or the like applied to the rotating aperture plate 8 and enclosure 6.

The illumination element 18 may be a fluorescent, halogen, incandescent or metal halide light source, or any other suitable light source. A light deflector 24, such as the concave light deflector depicted, preferably partially surrounds the illumination element 18 in order to maximize the intensity of the light emitted from the recessed light assembly 2.

Figure 3:
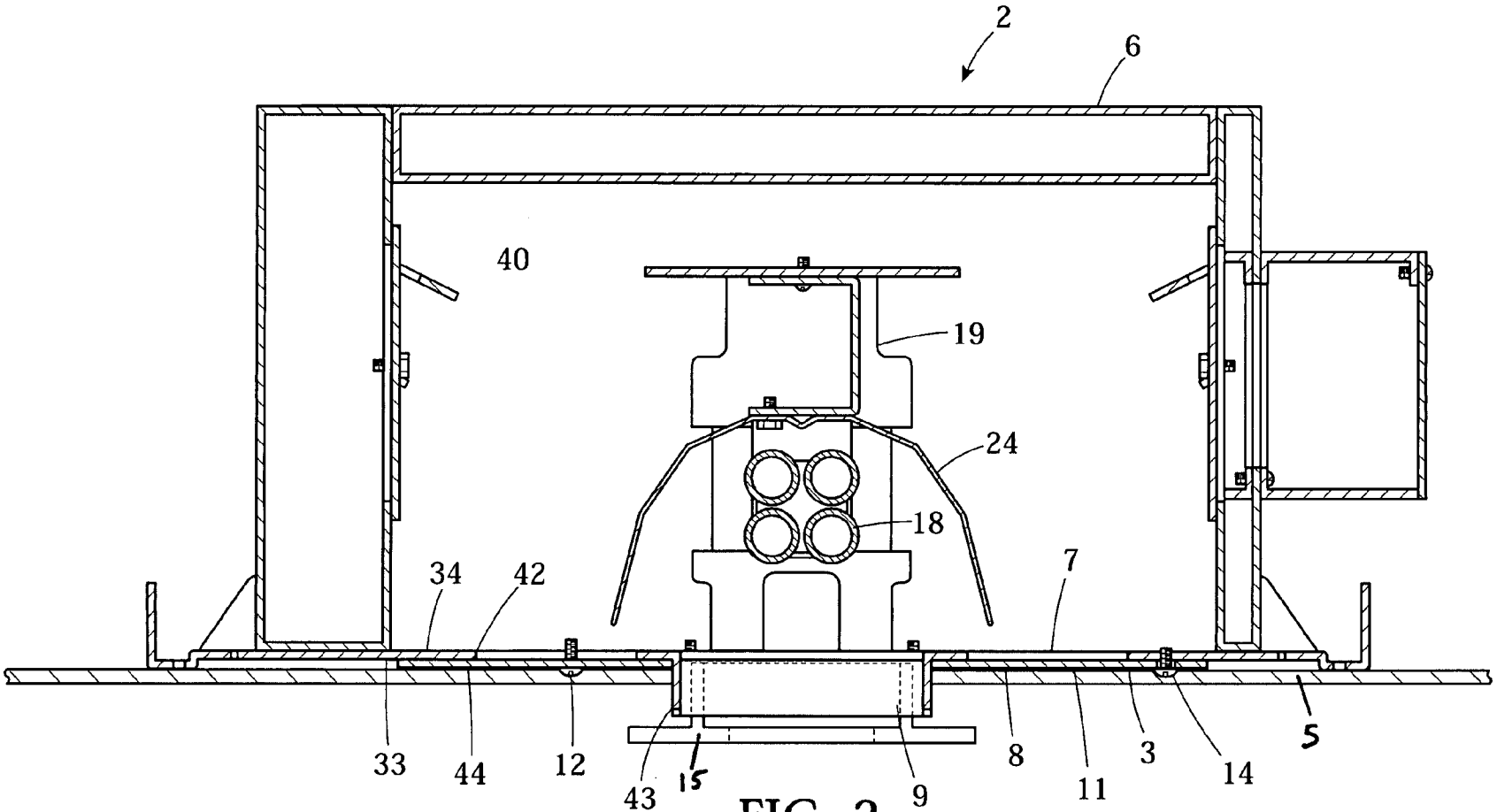
FIG. 3 is a cross sectional view of the recessed light assembly, taken along line 3-3 of FIG. 2.

The illumination element 18 is preferably mounted for rotation with the rotating aperture plate 8 such that the illumination element 18 does not rotate, relative to the rotating aperture plate 8, about the axis of rotation of the rotating aperture plate 8, such that the illumination element 18 does rotate with the rotating aperture plate 8 (and illumination aperture 9) about the axis of rotation. Thus, preferably, the rotational orientation of the illumination element 18, relative to the illumination aperture 9, is constant and does not change when the rotational alignment of the rotating aperture plate 8 changes relative to the enclosure 6. In other words, the rotational orientation of the illumination element 18, about the axis of rotation of the rotating aperture plate, 8 is constant or substantially constant, relative to the rotating aperture plate 8, and does not change as the rotating aperture plate 8 rotates relative to the enclosure 6. For instance, in FIG. 4, the aperture plate 8 is shown having an illumination element support 19 rigidly fixed to an interior surface 39 of the rotating aperture plate 8 radially outwardly from the illumination aperture 9 and, as depicted in FIG. 3, the illumination element support 19 extends into an interior 40 of the enclosure 6. Preferably, the illumination element support 19 has a substantially inverted-U shape.

Figure 4:
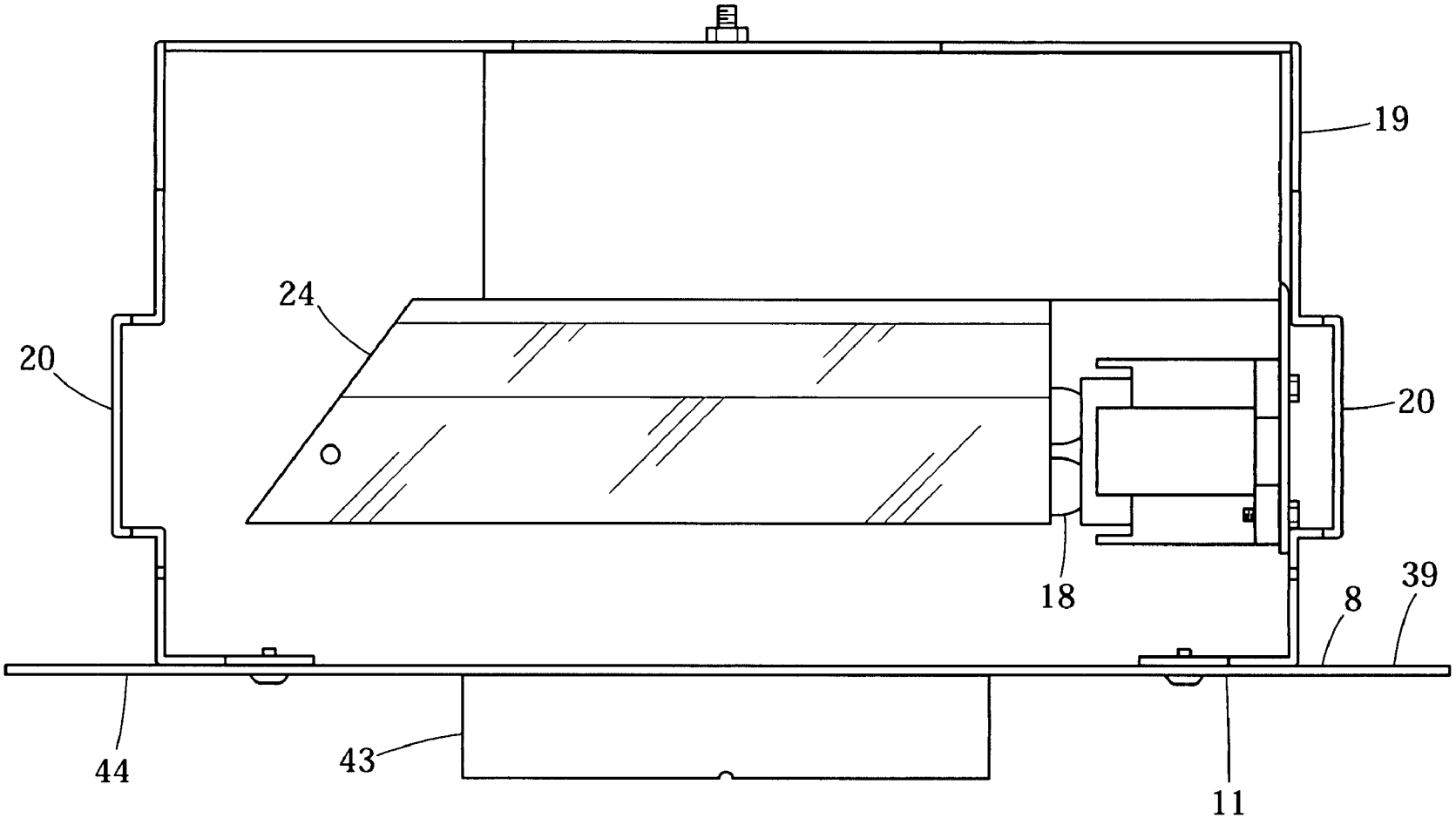
FIG. 4 is a side elevational view of a sub-assembly of the recessed light assembly, showing the rotating aperture plate and illumination element support.

As shown in FIG. 4, opposed sides 20 of the illumination element support 19 may be fixed to the rotating aperture plate 8 on opposed sides of the illumination aperture 9. It is desirable that the opening 7 in the wall 3 of the enclosure 6 is sized and shaped to permit the passage of the opposed sides 20 of the illumination element support 19 therethrough. A periphery 42 of the opening 7 in the wall 3 of the enclosure 6 is preferably disposed radially outwardly from the illumination element support 19 and from the areas in which the opposed sides 20 of the illumination element support 19 are fixed to the base 11 of the rotating aperture plate 8. Preferably the opening 7 in the wall 3 of the enclosure 6 is circular in shape and has a diameter that is greater than a distance between the opposed sides 20 of the illumination element support 19.

Preferably, the illumination element 18 is electrically connected to a power source, such as a junction box 46 fixed to the enclosure 6, by wires (not shown), which wires are sufficiently long to permit a full intended amount of rotation of the rotating aperture plate 8 relative to the enclosure 6. Alternatively or additionally, the illumination element 18 may be connected to the power source via a rotatable electrical connection which permits unlimited rotation of the rotating aperture plate 8 relative to the enclosure 6.

Alternatively, the illumination element 18 may be fixed relative to the enclosure 6, as in the prior art. In such an embodiment, the illumination element support 19 is fixed to the enclosure 6 and an illumination element 18 is suspended therefrom. In such an embodiment, the illumination element 18 does not rotate along with the rotating aperture plate 8.

The recessed light fixture 2 may include a trim or cover 15 removably mounted over and/or within the illumination aperture 9. The rotating aperture plate 8 may include a peripheral flange 43 around the illumination aperture 9 for receiving the removable cover 15. The trim and/or cover 15 conceal any space or gap between the finished ceiling and the illumination aperture 9 or peripheral flange 43 thereof to provide an attractive appearance.

Figure 5:
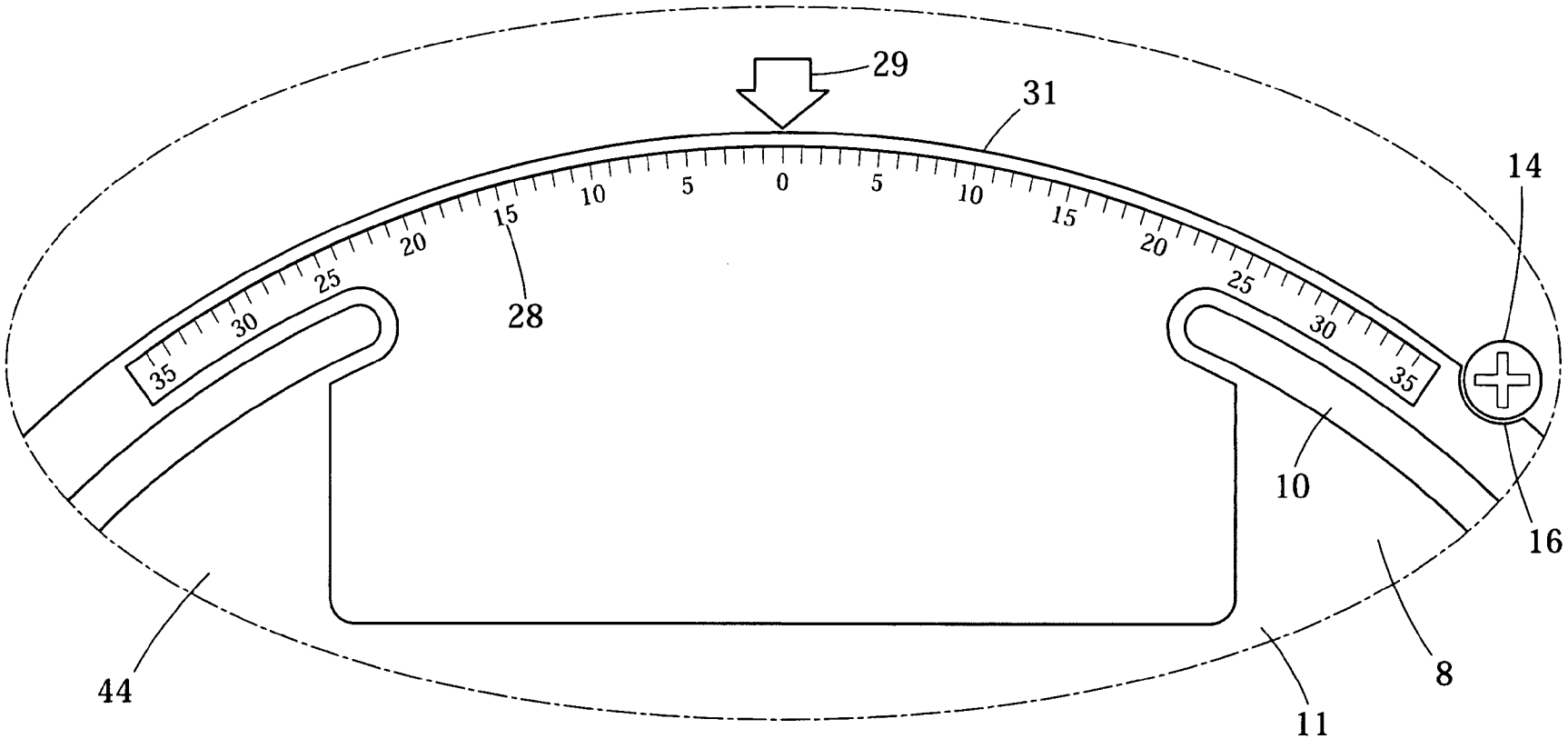
FIG. 5 is a magnified view of the area delineated in FIG. 2, showing the rotational alignment indicators and rotational alignment reference mark and showing the removable locking screw.

As best depicted in FIG. 5, the wall 3 of the enclosure 6 or rotating aperture plate 8 preferably has a plurality of rotational alignment indicators 28 affixed thereon, which alignment indicators 28 are disposed along an arc having a center of curvature that lies on or substantially on the center of rotation of the rotating aperture plate 8. Further, the corresponding rotating aperture plate 8 or wall 3 of the enclosure 6 preferably has a rotational alignment reference mark 29 affixed thereon adjacent the arc of rotational alignment indicators 28. The combination of the rotational alignment indicators and rotational alignment reference mark serves to indicate a present rotational alignment of the rotating aperture plate 8 and illumination aperture 9 relative to the enclosure 6, or, in other words, a present angular displacement of the rotating aperture plate 8 and illumination aperture 9 relative to a predetermined rotational alignment.

In the depicted embodiment, the rotational alignment indicators 28 are preferably affixed to an exterior surface 44 of the base 11 of the aperture plate 8 and the rotational alignment reference mark 29 is affixed to the exterior surface 33 of the enclosure 8. The rotational alignment indicators 28 are preferably primarily located between two adjacent arcuate slots 10. However, some or all of the rotational alignment indicators 28 may be located between an arcuate slot 10 and the periphery 31 of the base 11 of the rotating aperture plate 8.

The recessed lighting assembly may have a secondary locking mechanism to selectively fix the rotating aperture plate 8 in a positive, predetermined rotational alignment relative to the enclosure 6, such as a position in which the sides of a square illumination aperture are aligned parallel to adjacent sides of a rectilinear wall of an enclosure. When the rotating aperture plate 8 is in the predetermined rotational alignment, the rotational alignment reference mark 29 is preferably aligned with a rotational alignment indicator which indicates a zero amount (or no) angular displacement of the rotating aperture plate 8 relative to the enclosure 6.

The secondary locking mechanism is preferably an adjustable secondary fastener, such as a threaded fastener 14 that, when inserted and engaged, fixes the rotating aperture plate 8 in the positive, predetermined rotational alignment. It is contemplated that the recessed light assembly will be delivered to persons who install the recessed light assembly with the secondary fastener in place, so that such persons will be confident that the illumination apertures 9 are in a certain and consistent alignment. Further, the secondary faster may be painted or otherwise colored (e.g., red) to highlight or identify the secondary fastener and to distinguish the secondary fastener from the adjustable fastener.

The rotating aperture plate 8 or wall 3 of the enclosure has a passage 16, such as a detent in the periphery 31 of the base 11 of the rotating aperture plate 8, which passage 16 is sized to closely receive the secondary fastener 14 therethrough. The corresponding wall 3 of the enclosure 6 or rotating aperture plate 8 includes a secondary fastener seat 45 to engagingly receive the secondary fastener therein. When the rotating aperture plate 8 is in the predetermined rotational alignment, the passage 16 is aligned with the fastener seat 45 and the secondary fastener 14 is insertable through the passage 16 and into the secondary fastener seat 45 thereby fixing the rotating aperture plate 8 in the predetermined rotational alignment. Preferably, the secondary fastener 14 must be completely removed in order to rotate the rotating aperture plate 8 out of the predetermined alignment.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

What is claimed is:

1. A recessed lighting assembly, comprising:

an enclosure fixable to a support structure of a dwelling, said enclosure having a wall with an opening therethrough;

an illumination element disposed within said enclosure;

a rotating aperture plate having an illumination aperture;

said opening and said illumination aperture forming a passageway to permit light emitted from said illumination element to exit said enclosure;

said illumination aperture having an area less than an area of said opening in said wall of said enclosure and having a non-round shape substantially different than a shape of said opening in said wall of said enclosure;

a base of said rotating aperture plate having a substantially circular periphery that is within a substantially rectilinear periphery of said wall of said enclosure, and said base being disposed on an exterior surface of said wall of said enclosure;

means for selectively permitting and preventing rotation of said rotating aperture plate relative to said enclosure;

a rotational alignment of said illumination aperture relative to said enclosure being adjustable by selective rotation of said rotating aperture plate relative to said enclosure;

said rotating aperture plate having a plurality of arcuate slots, each arcuate slot having an associated adjustable fastener directed therethrough into said wall of said enclosure;

each adjustable fastener being directed through said associated arcuate slot from an exterior surface of said base of said rotating aperture plate and being accessible and adjustable from an exterior of said recessed lighting assembly;

selective engagement and disengagement of said adjustable fasteners providing selective fixation and rotation, respectively, of said rotating aperture plate relative to said enclosure;

said adjustable fasteners being operable to maintain a connection between said rotating aperture plate and said enclosure when said adjustable fasteners are disengaged, whereby a rotational alignment of said rotating aperture plate may be safely and conveniently adjusted;

said rotating aperture plate having a center of rotation, relative to said enclosure, that lies on or substantially on a center of said illumination aperture;

said illumination element being mounted for rotation with said rotating aperture plate and being suspended from an illumination element support which extends into an interior of said enclosure and which is fixed to an interior surface of said rotating aperture plate;

a periphery of said opening in said wall of said enclosure being disposed radially outwardly from said illumination element support to permit insertion of said illumination element support into said enclosure and to permit rotation of said rotating aperture plate relative to said enclosure;

said rotating aperture plate having first and second rotational alignment positions with respect to said enclosure; and said rotating aperture plate being adjustable to any position between and including said first and second rotation alignment positions.

2. A recessed lighting assembly, as in claim 1, wherein:

one of said rotating aperture plate or said wall of said enclosure has a rotational alignment reference mark affixed thereto;

an other of said rotating aperture plate or said wall of said enclosure has a plurality of rotational alignment indicators affixed thereto, said rotational alignment indicators being disposed along an arc having a center of curvature that lies on or substantially on said center of rotation of said rotating aperture plate; and said rotational alignment reference mark and one of said plurality of rotation alignment indicators indicating a present rotational alignment of said rotating aperture plate relative to said enclosure.

3. A recessed lighting assembly, as in claim 1, further comprising:

a locking fastener operable, when inserted, to fix said rotating aperture plate in a positive, predetermined rotational alignment relative to said enclosure;

one of said rotating aperture plate or said wall of said enclosure including a passage for said locking fastener, said passage being sized to closely receive said locking fastener therethrough, an other of said rotating aperture plate or said wall of said enclosure including a locking fastener seat to engagingly receive said locking fastener therein;

when said rotating aperture plate is in said predetermined rotational alignment relative to said enclosure, said passage being aligned with said locking fastener seat and said locking fastener being insertable through said passage and into said locking fastener seat to fix said rotating aperture plate in said predetermined rotational alignment relative to said enclosure;

said passage comprises a detent in a periphery of a base portion of said rotating aperture plate; and said locking fastener seat comprise a threaded hole in said wall of said enclosure.

4. A recessed lighting assembly fixable to a support structure, comprising:

an enclosure;

an illumination element disposed within said enclosure;

a non-round illumination aperture forming a light passageway to permit light emitted from said illumination element to exit said lighting assembly;

a rotational alignment of said non-round illumination aperture being adjustable relative to said support structure among at least first and second rotational alignment positions;

said first and second rotational alignment positions being within or at 35 degrees of one another;

said rotational alignment of said non-round illumination aperture is adjustable to any position between and including said first and second rotation alignment positions;

said rotational alignment of said non-round illumination aperture being adjustable by selective rotation of a rotating aperture plate relative to said enclosure;

means for selectively clamping said rotating aperture plate to a enclosure;

said clamping means comprises one of said rotating aperture plate or said wall of said enclosure having an arcuate slot therethrough, and an adjustable fastener directed through said arcuate slot and into an other of said rotating aperture plate or said wall of said enclosure; and selective engagement and disengagement of said adjustable fastener providing selective fixation and rotation, respectively, of said rotating aperture plate relative to said enclosure.

5. A recessed lighting assembly, as in claim 4, wherein:

said adjustable fastener need not be removed for selective rotation of said rotating aperture plate.

6. A recessed lighting assembly, as in claim 5, further comprising a plurality of arcuate slots, each arcuate slot having an associated adjustable fastener directed therethrough.

7. A recessed lighting assembly, as in claim 6, wherein:

said associated adjustable fasteners need not be removed for selective rotation of said rotating aperture plate.

8. A recessed lighting assembly, as in claim 4, wherein:

a base of said rotating aperture plate is disposed on an exterior surface of said wall of said enclosure;

said arcuate slot is disposed on said base of said rotating aperture plate;

said adjustable fastener is directed through said arcuate slot from an exterior surface of said base of said rotating aperture plate and into said wall of said enclosure; and said adjustable fastener is accessible and adjustable from an exterior of said recessed lighting assembly.

9. A recessed lighting assembly, as in claim 8, wherein:

said rotating aperture plate has a plurality of arcuate slots, each arcuate slot having an associated adjustable fastener directed therethrough into said wall of said enclosure.

10. A recessed lighting assembly, as in claim 9, wherein:

each said associated adjustable fastener is accessible and adjustable from an exterior of said recessed lighting assembly.

11. A recessed lighting assembly, as in claim 8, wherein:

said adjustable fastener is operable to maintain a connection between said rotating aperture plate and said enclosure when said adjustable fastener is disengaged to permit rotation of said rotating aperture plate relative to said enclosure;

whereby rotational alignment of said rotating aperture plate may be safely and conveniently adjusted when said base of said rotating aperture plate is vertically below said wall of said enclosure.

12. A recessed lighting assembly, as in claim 4, wherein:

said wall portion has an interior surface;

a base portion of said rotating aperture plate has a substantially planar surface; and said surface of said base portion abuts a substantially planar portion of said interior surface of said wall portion.

13. A recessed lighting assembly fixable to a support structure, comprising:

an enclosure;

an illumination element disposed within said enclosure;

a rotating aperture plate;

a non-round illumination aperture forming a light passageway to permit light emitted from said illumination element to exit said lighting assembly;

a rotational alignment of said non-round illumination aperture being adjustable relative to said support structure of among at least first and second rotational alignment positions;

said first and second rotational alignment positions being within or at 35 degrees of one another;

said rotational alignment of said non-round illumination aperture is adjustable to any position between and including said first and second rotation alignment positions;

said rotational alignment of said non-round illumination aperture being adjustable by selective rotation of said rotating aperture plate relative to said enclosure;

said illumination element is affixed to and rotates with said rotating aperture plate;

said illumination element is suspended from an illumination element support;

said illumination element support is fixed to an interior surface of said rotating aperture plate radially outwardly from said illumination aperture; and said illumination element support extends into an interior of said enclosure.

14. A recessed lighting assembly, as in claim 13, wherein:

a periphery of said opening in a wall of said enclosure is sized and shaped to permit rotation of said rotating aperture plate relative to said enclosure.

15. A recessed lighting assembly, as in claim 13, wherein:

said periphery of said opening in a wall of said enclosure is disposed radially outwardly from said illumination element support.

16. A recessed lighting assembly, as in claim 15, wherein:

said periphery of said opening in said wall of said enclosure is disposed radially outwardly from an area in which said illumination element support is fixed to said rotating aperture plate to permit rotation of said rotating aperture plate relative to said enclosure.

17. A recessed lighting assembly, as in claim 15 wherein:

opposed sides of said illumination element support are fixed to said rotating aperture plate on opposed sides of said illumination aperture;

said opening of said wall of said enclosure is sized and shaped to permit the passage of said opposed sides of said illumination element support therethrough.

18. A recessed lighting assembly, as in claim 13, wherein:

a wall portion of said enclosure has a substantially planar portion;

said rotating aperture plate has a substantially planar surface; and said substantially planar surface of said rotating aperture plate abuts said substantial planar portion of said wall portion of said enclosure.

19. A recessed lighting assembly, as in claim 13, further comprising:

said enclosure having a wall portion;

an arcuate slot and a fastener directed through the arcuate slot for rotationally connecting said rotating aperture plate to said wall portion;

said arcuate slot is in one of said wall portion and said rotating aperture plate; and said fastener is connected to the other of said wall portion and said rotating aperture plate.

20. A recessed lighting assembly, as in claim 15, further comprising:

a plurality of arcuate slots and a plurality of fasteners directed through the arcuate slots for rotationally connecting said rotating aperture plate to said wall portion.

21. A recessed lighting assembly fixable to a support structure, comprising:

an enclosure;

an illumination element disposed within said enclosure;

a rotating aperture plate;

a non-round illumination aperture forming a light passageway to permit light emitted from said illumination element to exit said lighting assembly;

a rotational alignment of said non-round illumination aperture being adjustable relative to said support structure among at least first and second rotational alignment positions;

said first and second rotational alignment positions being within or at 35 degrees of one another;

said rotational alignment of said non-round illumination aperture is adjustable to any position between and including said first and second rotation alignment positions;

said rotational alignment of said non-round illumination aperture being adjustable by selective rotation of said rotating aperture plate relative to said enclosure;

one of said rotating aperture plate or a wall of said enclosure has a rotational alignment reference mark affixed thereto;

an other of said rotating aperture plate or said wall of said enclosure has a plurality of rotational alignment indicators affixed thereto;

said rotational alignment indicators are disposed along an arc having a center of curvature that lies on or substantially on a center of rotation of said rotating aperture plate; and said rotational alignment reference mark and one of said plurality of rotation alignment indicators indicating a present rotational alignment of said rotating aperture plate relative to said enclosure.

22. A recessed lighting assembly fixable to support structure, comprising:

an enclosure;

an illumination element disposed within said enclosure;

a rotating aperture plate;

a non-round illumination aperture forming a light passageway to permit light emitted from said illumination element to exit said lighting assembly;

a rotational alignment of said non-round illumination aperture being adjustable relative to said support structure among at least first and second rotational alignment positions;

said first and second rotational alignment positions being within or at 35 degrees of one another;

said rotational alignment of said non-round illumination aperture is adjustable to any position between and including said first and second rotation alignment positions;

said rotational alignment of said non-round illumination aperture being adjustable by selective rotation of said rotating aperture plate relative to said enclosure;

a locking mechanism to selectively fix said rotating aperture plate in a positive, predetermined rotational alignment relative to said enclosure;

said locking mechanism having a locking fastener operable, when inserted, to fix said rotating aperture plate in said positive, predetermined rotational alignment relative to a enclosure;

one of said rotating aperture plate or said wall of said enclosure includes a passage for said locking fastener, said passage being sized to closely receive said locking fastener therethrough;

an other of said rotating aperture plate or said wall of said enclosure includes a locking fastener seat to engagingly receive said locking fastener therein; and when said rotating aperture plate is in said predetermined rotational alignment relative to said enclosure, said passage is aligned with said locking fastener seat and said locking fastener is insertable through said passage and into said locking fastener seat to fix said rotating aperture plate in said predetermined rotational alignment relative to said enclosure.

23. A recessed lighting assembly, as in claim 22, wherein:

said locking fastener comprises a threaded fastener;

said passage comprises a detent in a periphery of a base portion of said rotating aperture plate; and said locking fastener seat comprise a threaded hole in said wall of said enclosure.

24. A recessed lighting assembly, as in claim 18, wherein:

said wall portion has an exterior surface and said substantially planar portion of said wall portion is on said exterior surface; and said rotating aperture plate has an interior surface and said substantially planar surface of said rotating aperture plate is on said interior surface.

25. A recessed lighting assembly, as in claim 18, wherein:

said wall portion has an interior surface and said substantially planar portion of said wall portion is on said interior surface.

* * * * *